US007785120B2

(12) United States Patent
Seidel

(10) Patent No.: US 7,785,120 B2
(45) Date of Patent: Aug. 31, 2010

(54) CLAMPING CONNECTOR FOR A CONDUCTOR RAIL

(75) Inventor: Dieter Seidel, Steinen (DE)

(73) Assignee: Conductix-Wampfler AG, Weil am Rhein-Markt (DE)

( * ) Notice: Subject to any disclaimer, the term of this patent is extended or adjusted under 35 U.S.C. 154(b) by 103 days.

(21) Appl. No.: 12/192,641

(22) Filed: Aug. 15, 2008

(65) Prior Publication Data

US 2009/0047810 A1 Feb. 19, 2009

(30) Foreign Application Priority Data

Aug. 18, 2007 (DE) ..... 10 2007 039 143

(51) Int. Cl.
*H01R 4/60* (2006.01)

(52) U.S. Cl. ..... 439/210

(58) Field of Classification Search ..... 439/94, 439/210, 100; 174/68.3, 68.1
See application file for complete search history.

(56) References Cited

U.S. PATENT DOCUMENTS 4,121,879 A * 10/1978 Olsen ..... 439/94
5,332,866 A * 7/1994 Sawamura ..... 174/101

FOREIGN PATENT DOCUMENTS

DE 295 18 253 2/1996
DE 295 20 491 3/1996

* cited by examiner

*Primary Examiner*—Javaid Nasri
(74) *Attorney, Agent, or Firm*—Martin Fleit; Paul D. Bianco; Fleit Gibbons Gutman Bongini & Bianco PL

(57) ABSTRACT

The invention pertains to a conductor rail (1), particularly an enclosed conductor rail, with a housing (2) and at least one conductor band (4, 6) extending therein, as well as a connector (3) for connecting the conductor bands (4, 6) of adjacent segments (1*a*, 1*b*) of the conductor rail, wherein the electrically conductive conductor bands (4, 6) are bent outward at the ends of the conductor rail segments so as to electrically connect the conductor bands. In order to easily and manually produce a connection between conductor rail segments of such a conductor rail with the fewest components possible and such that a high system reliability is preserved, the invention proposes that the conductor bands (4, 6) be bent outward by 180° and that the connector (3) be realized in the form of a clamping connector that encompasses and presses the bent ends of the conductor bands against one another in the region of their bend forming a contact surface (5).

22 Claims, 3 Drawing Sheets

CLAMPING CONNECTOR FOR A CONDUCTOR RAIL

FIELD OF THE INVENTION

The invention pertains to a conductor rail, particularly an enclosed conductor rail, and to a method for connecting conductor bands of adjacent segments of a conductor rail, as well as to the utilization of a clamping connector for connecting conductor bands of adjacent segments of a conductor rail.

BACKGROUND OF THE INVENTION

A conductor rail is known from the company brochure "Kastenschleifleitungen Program 0842" of the firm Wampfler AG. The conductor rail segments of the enclosed conductor rail described in this brochure can be connected to one another in different ways. One option for producing this connection consists of bending the ends of the conductor bands extending in the housing of the enclosed conductor rail outward by 90°. The outwardly bent ends of the conductor bands of adjacent conductor rail segments can then be electrically and mechanically connected to one another by means of an angular clamping connector that can be clamped or screwed over the joined ends of the conductor bands of adjacent conductor rail segments that protrude transversely from the housing.

However, it has been determined that this connection between conductor rail segments is complicated to produce during the installation. In addition, transport of the yet uninstalled conductor rail segments is difficult due to the outwardly protruding ends of the conductor bands, the protruding conductor band ends may be bent or broken off during transport.

SUMMARY OF THE INVENTION

Based on these circumstances, the invention aims to improve a conductor rail of the initially cited type such that a simple connection between conductor rail segments can be manually produced with the fewest components possible, and such that a high system reliability is preserved. In addition, the invention aims to simplify the transport of yet uninstalled conductor rail segments. The contact point at which the conductor bands of adjacent conductor rail segments are connected to one another should be largely vibration-proof and have an adequate electric conductivity.

These objectives are attained with a conductor rail and with a method for connecting conductor bands of adjacent segments of a conductor rail as set forth herein, as well as with the utilization of a clamping connector for connecting conductor bands of adjacent segments of a conductor rail. Preferred embodiments of the inventive conductor rail are disclosed herein.

BRIEF DESCRIPTION OF THE DRAWINGS

One embodiment of the invention is described in greater detail below with reference to the accompanying drawings. In these drawings.

DETAILED DESCRIPTION OF THE INVENTION

Figure 1A:
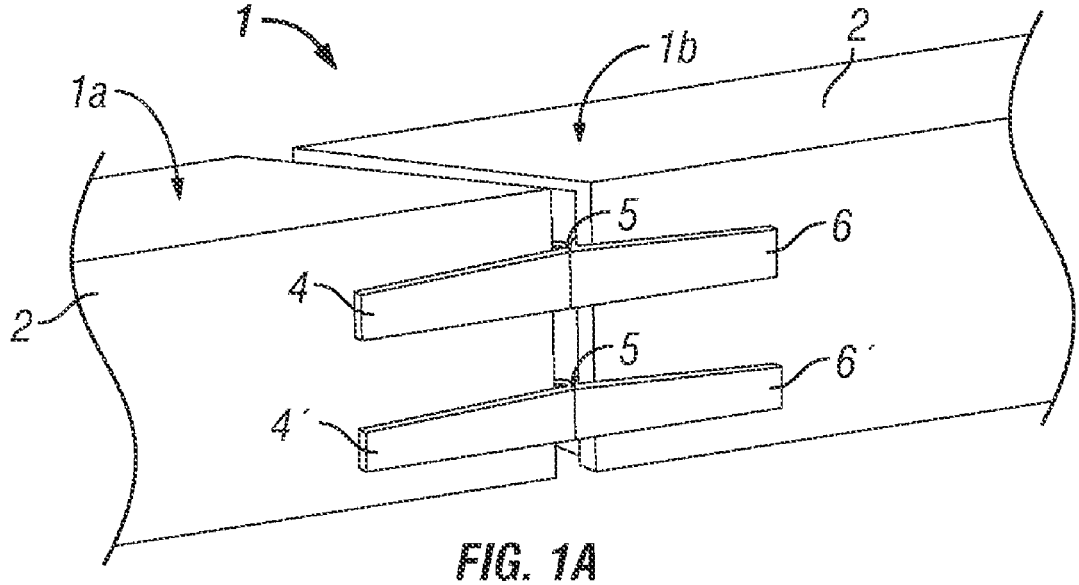
FIG. 1*a* shows an oblique representation of the connecting point between two conductor rail segments with conductor band ends that are bent outward by 180°.

The enclosed conductor rail illustrated in the form of an oblique representation in FIG. 1 consists of several conductor rail segments 1*a*, 1*b* that are electrically and mechanically connected to one another at their ends. The enclosed conductor rail comprises a box-shaped housing 2 of an electrically insulating material, usually plastic, and one or more conductor bands 4, 4', 6, 6' of an electrically conductive material such as, for example, copper band that extend in the housing. The embodiment of the inventive conductor rail illustrated in FIG. 1 comprises two conductor bands, wherein the conductor bands extending in the conductor rail segment 1*a* are identified by the reference numerals 4 and 4' and the conductor bands extending in the conductor rail segment 1*b* are identified by the reference numerals 6 and 6'. At the contact point between two successive conductor rail segments 1*a*, 1*b* that is illustrated in the form of an oblique representation in FIG. 1, the ends of the conductor bands 4, 4' and 6, 6' are bent out of the housing 2 by 180°. The outwardly bent ends of the conductor bands 4, 4' and 6, 6' are tapered toward their end, in particular being tapered rearward in the embodiment shown. In the region of the bend in the conductor bands 4, 4' and 6, 6', the faces of the upper conductor bands 4, 6 and the lower conductor bands 4', 6' of the two conductor rail segments 1*a* and 1*b* abut one another. The bend in the conductor bands consequently forms a contact surface 5, at which the respectively corresponding conductor bands 4, 6 and 4', 6' are in electrical contact with one another and thus ensure the current flow from the conductor rail segment 1*a* to the adjacent conductor rail segment 1*b*.

Figure 1B:
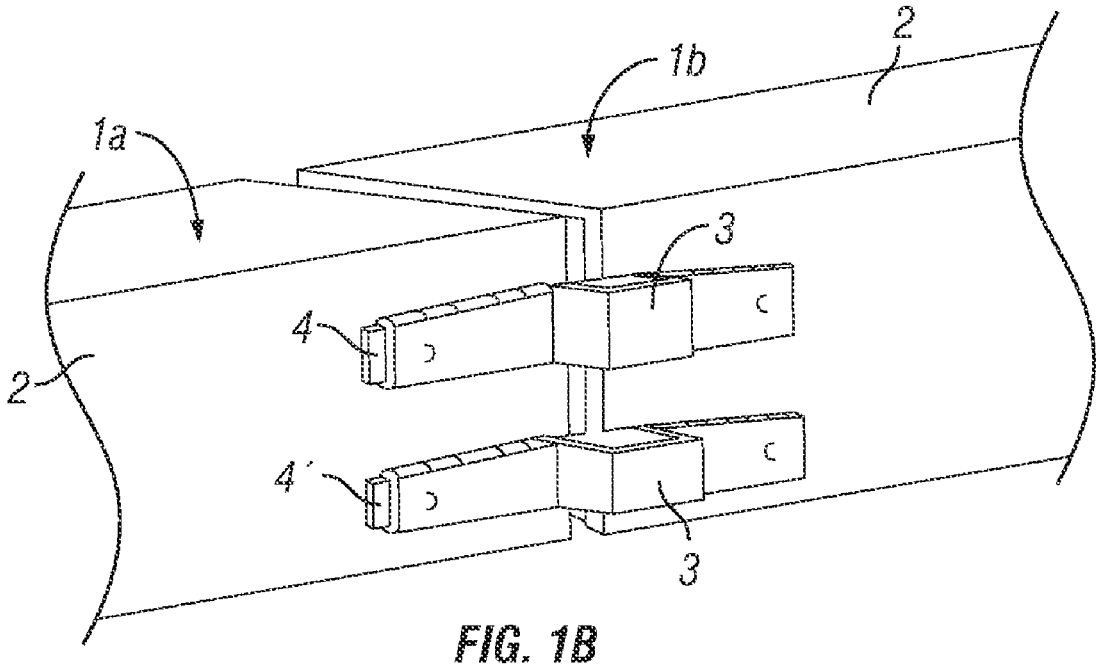
FIG. 1*b* shows the region of the contact point between the conductor rail segments according to FIG. 1*a* during an intermediate step of the inventive method.
Figure 1C:
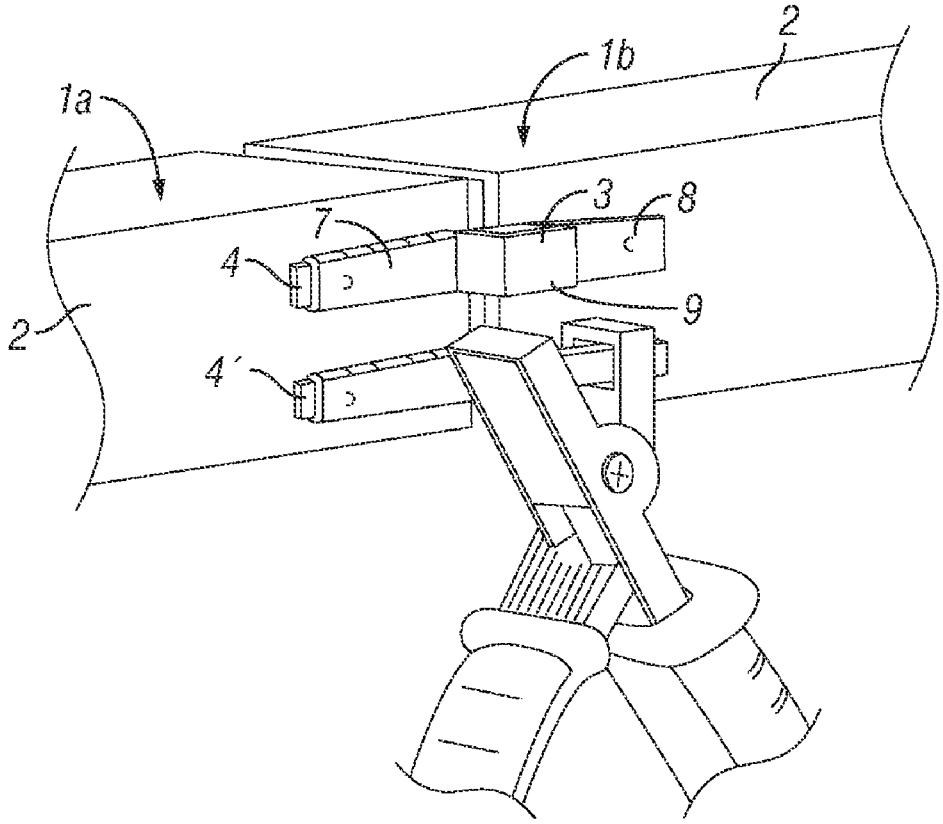
FIG. 1*c* shows the contact point between the conductor rail segments according to FIG. 1*a* during another intermediate step of the inventive method.
Figure 2A:
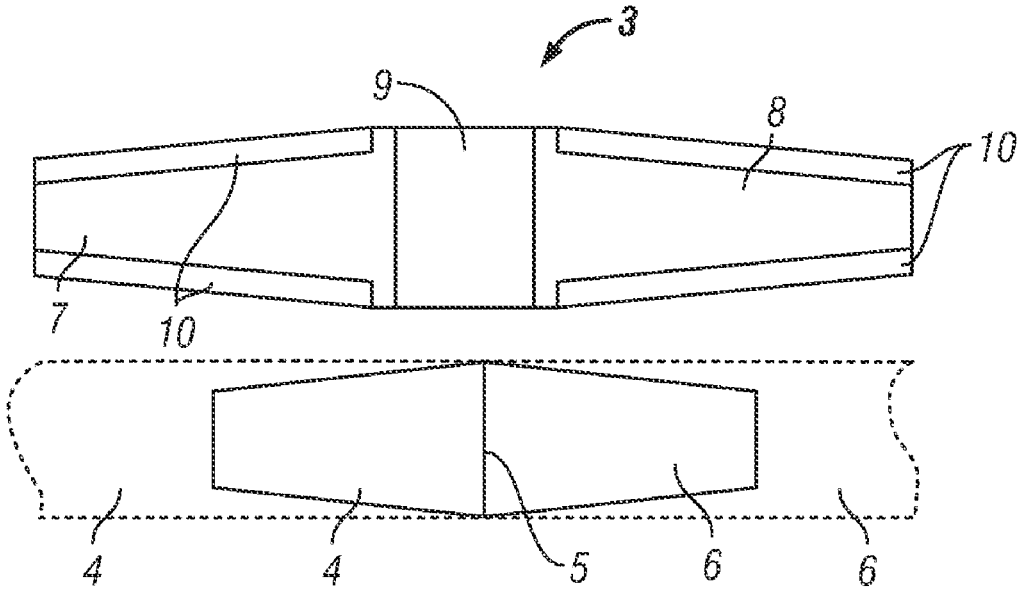
FIG. 2*a* shows a front view of a clamping connector for connecting conductor rail segments of a conductor rail (top), and a side view of a contact point between two adjacent conductor rail segments with conductor bands that are bent outward by 180° (bottom)

FIG. 2*a* shows a front view of a clamping connector 3 that is made of an electrically conductive material (FIG. 2*a*, top). The illustration below this front view shows the contact point between the conductor bands 4 and 6 of the conductor rail segments 1*a* and 1*b* in the form of a side view (FIG. 2*a*, bottom). The clamping connector 3 shown in the top illustration of FIG. 2*a* consists of two wings 7, 8 and a deformation area 9 arranged between the two wings. The deformation area 9 may consist of a material that is easier to deform or be of the same material as the two wings 7, 8, in which case the material is realized thinner. However, the wings 7, 8 and the deformation area 9 may also consist of the same material and have the same thickness. The deformation area 9 is delimited from the wings 7, 8 by grooves or bending lines. FIG. 1*c* shows the clamping connector 3 in the form of an oblique representation, in which the deformation area 9 is bent upward relative to the wings 7, 8 and projects from the plane of the wings 7, 8.

Figure 1D:
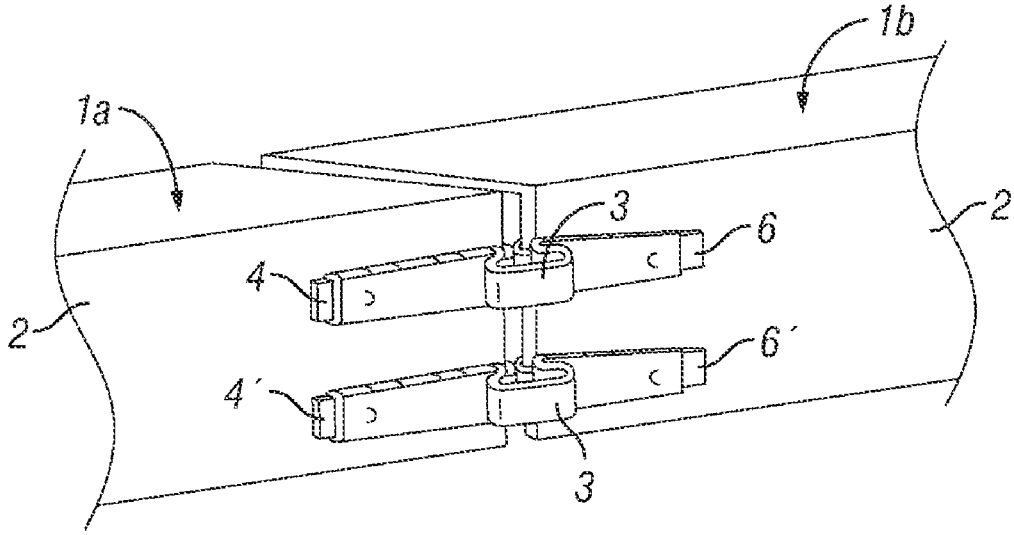
FIG. 1*d* shows an oblique representation of the contact point between conductor rail segments that are electrically and mechanically connected in accordance with the invention by means of clamping connectors.
Figure 2B:
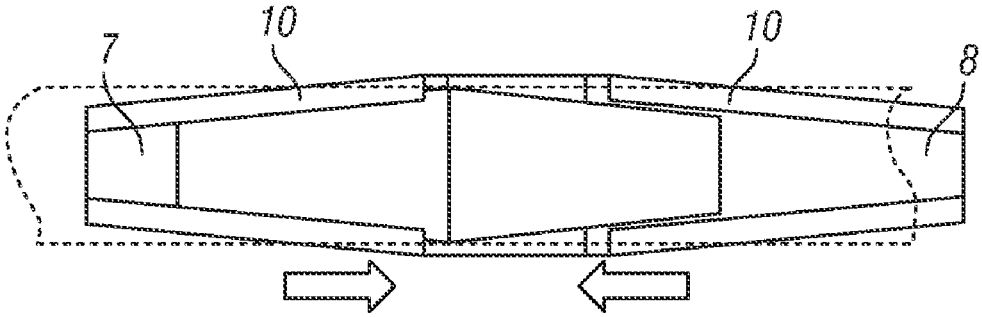
FIG. 2*b* shows a schematic representation of the connection between the conductor rail segments according to FIG. 2*a* during an intermediate step of the inventive method.
Figure 2C:
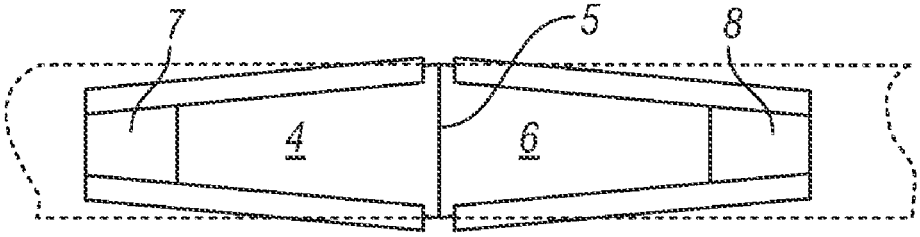
FIG. 2*c* shows a schematic representation of the contact point between the conductor rail segments according to FIG. 2*a* (bottom) that are connected to one another by means of the clamping connector according to FIG. 2*a* (top).

In order to connect the ends of the respective conductor bands 4, 6 and 4', 6' of adjacent conductor rail segments 1*a*, 1*b*, the clamping connector 3 is initially pushed over a bent end of a conductor band 4 with a wing 7, as shown in FIG. 2*b*. In order to enable the wing 7 of the clamping connector 3 to encompass the end of the conductor band 4, wraparound flaps 10 are provided on the inner side of each wing 7, 8 of the clamping connector 3. Consequently, the clamping connector 3 can be pushed over the end of a conductor band 4 such that the wraparound flaps 10 encompass the end of the conductor band 4 and produce a clamping connection with the conductor band 4. Subsequently, the clamping connector 3 is pulled slightly toward the adjacent conductor rail segment 1*b* in the longitudinal direction and the second wing 8 that also features a wraparound flap 10 is pushed over the outwardly bent end of the corresponding conductor band 6. In particular, the deformation area 9 of the clamping connector 3 returns to its original shape due to its flexibility and elastic properties. FIG. 1*b* shows the contact point between the two conductor rail segments 1*a* and 1*b* during this stage of the inventive method. In order to stabilize the connection and to produce an electrical contact between the corresponding conductor bands 4, 6 and 4', 6', the clamping connector 3 is compressed in the deformation area 9 by means of pliers or another deformation tool, as shown in FIG. 1*c*. Due to the compression of the clamping connector 3, the clamping connector 3 contracts in its longitudinal direction and thus presses the ends of the respective conductor bands 4, 6 and 4', 6' inserted into its wings 7, 8 against one another. Due to the outwardly tapered ends of the respective conductor bands 4, 6 and 4', 6', the clamping connector 3 is additionally pushed to the ends of the respective conductor bands 4, 6 and 4', 6' during the compression of the deformation area 9. The shape of the wings 7, 8 of the clamping connector 3 is adapted to the shape of the ends of the conductor bands 4, 6 such that during compression of the deformation area of clamping connector 3, the faces of the respective conductor bands 4, 6 and 4', 6' are simultaneously pressed against one another in the region of the bends in order to form a contact surface 5. FIG. 1*d* shows the contact point between the conductor rail segments 1*a*, 1*b* with the respective conductor bands 4, 6 and 4', 6' that are pressed against one another by means of the clamping connector 3. FIG. 2*c* shows this contact point with the contact surface 5 in the form of a side view from inside.

The inventive connection between the conductor bands of adjacent conductor rail segments ensures a connection between the conductor bands that has an adequate electrical conductivity and is produced with defined clamping and contact forces. The handling of the clamping connector is very simple, and only a few components are required to produce the connection, namely only the clamping connector 3. The installation can also be carried out manually with the aid of a clamping tool. Furthermore, the transport of yet uninstalled conductor rail segments 1*a*, 1*b* also does not create any problems because the ends of the conductor bands do not protrude perpendicularly outward from the housing as in the state of the art, but rather are bent by 180°. The clamping connector also allows a simple disassembly of the conductor rail segments because the compressed clamping connector can also be easily expanded again and pulled off the bent ends of the conductor bands.

The invention claimed is:

1. A conductor rail (1), particularly an enclosed conductor rail, with a housing (2) and at least one electrically conductive conductor band (4, 6) extending therein, as well as a connector (3) for connecting the conductor bands (4, 6) of adjacent segments (1*a*, 1*b*) of the conductor rail, wherein the electrically conductive conductor bands (4, 6) are bent outward at ends of the adjacent segments in order to electrically connect the conductor bands, wherein the conductor bands (4, 6) are bent outward by 180°, and the connector (3) is realized in a form of a clamping connector that encompasses and presses bent ends of the conductor bands against one another in a region of their bend forming a contact surface (5).

2. The conductor rail according to claim 1, wherein the bent ends of the conductor bands (4, 6) are tapered toward their end.

3. The conductor rail according to claim 2, wherein the connector (3) consists of an electrically conductive material.

4. The conductor rail according to claim 3, wherein the connector (3) features two wings (7, 8) and a deformation area (9) arranged between the two wings, wherein the wings (7, 8) serve for encompassing the bent ends of the conductor bands, and the connector (3) can be compressed in a longitudinal direction in the deformation area (9).

5. The conductor rail according to claim 4, wherein the wings (7, 8) feature wraparound flaps (10) that encompass the bent ends of the conductor bands.

6. The conductor rail according to claim 4, wherein the wings (7, 8) are outwardly tapered.

7. The conductor rail according to claim 6, wherein the wings (7, 8) feature wraparound flaps (10) that encompass the bent ends of the conductor bands.

8. The conductor rail according to claim 2, wherein the connector (3) features two wings (7, 8) and a deformation area (9) arranged between the two wings, wherein the wings (7, 8) serve for encompassing the bent ends of the conductor bands, and the connector (3) can be compressed in a longitudinal direction in the deformation area (9).

9. The conductor rail according to claim 8, wherein the wings (7, 8) are outwardly tapered.

10. The conductor rail according to claim 9, wherein the wings (7, 8) feature wraparound flaps (10) that encompass the bent ends of the conductor bands.

11. The conductor rail according to claim 9, wherein the wings (7, 8) feature wraparound flaps (10) that encompass the bent ends of the conductor bands.

12. The conductor rail according to claim 1, wherein the connector (3) consists of an electrically conductive material.

13. The conductor rail according to claim 12, wherein the connector (3) features two wings (7, 8) and a deformation area (9) arranged between the two wings, wherein the wings (7, 8) serve for encompassing the bent ends of the conductor bands, and the connector (3) can be compressed in a longitudinal direction in the deformation area (9).

14. The conductor rail according to claim 13, wherein the wings (7, 8) are outwardly tapered.

15. The conductor rail according to claim 14, wherein the wings (7, 8) feature wraparound flaps (10) that encompass the bent ends of the conductor bands.

16. The conductor rail according to claim 14, wherein the wings (7, 8) feature wraparound flaps (10) that encompass the bent ends of the conductor bands.

17. The conductor rail according to claim 1, wherein the connector (3) features two wings (7, 8) and a deformation area (9) arranged between the two wings, wherein the wings (7, 8) serve for encompassing the bent ends of the conductor bands, and the connector (3) can be compressed in a longitudinal direction in the deformation area (9).

18. The conductor rail according to claim 17, wherein the wings (7, 8) are outwardly tapered.

19. The conductor rail according to claim 18, wherein the wings (7, 8) feature wraparound flaps (10) that encompass the bent ends of the conductor bands.

20. The conductor rail according to claim 17, wherein the wings (7, 8) feature wraparound flaps (10) that encompass the bent ends of the conductor bands.

21. A method for connecting conductor bands of adjacent segments of a conductor rail (1), particularly an enclosed conductor rail, said method comprises:

providing a conductor rail, wherein the adjacent segments (1*a*, 1*b*) feature a housing (2) and at least one electrically conductive conductor band (4, 6) extending therein, an end of said conductor band bent outward by 180°;

attaching a deformable clamping connector (3) on outwardly bent ends of the conductor bands (4, 6) of two adjacent segments of a conductor rail (1*a*, 1*b*), and deforming, particularly compressing, the clamping connector (3) in a longitudinal direction such that the conductor bands (4, 6) are pressed against one another in a region of their bend forming a contact surface (5).

22. A method for connecting conductor bands of adjacent segments of a conductor rail, said method comprises:

providing a conductor rail, wherein the adjacent segments feature a housing and at least one electrically conductive conductor band extending therein, wherein an end of said conductor band is bent outward;

providing a deformable clamping connector, the connector including two wings and a deformable deformation area arranged between the wings; attaching the wings of the clamping connector on outwardly bent ends of the conductor bands of two adjacent segments of a conductor rail, and deforming, particularly compressing, the clamping connector in a longitudinal direction in the deformation area such that the conductor bands are pressed against one another in a region of their bend forming a contact surface.

* * * * *